US005288561A

United States Patent [19]

Kibata et al.

[11] Patent Number: 5,288,561

[45] Date of Patent: Feb. 22, 1994

[54] HIGH TEMPERATURE HEAT-TREATING JIG

[75] Inventors: Masanori Kibata; Noboru Kitamori; Shigeki Kajima; Kazunori Yokosu; Mituo Kawai; Hideo Ishihara; Noriaki Yagi, all of Kanagawa, Japan

[73] Assignee: Kabushiki Kaisha Toshiba, Kawasaki, Japan

[21] Appl. No.: 784,179

[22] Filed: Oct. 30, 1991

[30] Foreign Application Priority Data

Oct. 30, 1990 [JP] Japan ..... 2-292419

[51] Int. Cl.[5] ..... F27D 5/00

[52] U.S. Cl. ..... 428/664; 266/274; 432/258

[58] Field of Search ..... 428/663, 664, 665; 432/258, 259; 266/274

[56] References Cited

U.S. PATENT DOCUMENTS

| | | | |
|---|---|---|---|
| 1,954,189 | 4/1934 | Gessel et al. | 428/665 |
| 3,161,478 | 12/1964 | Chessin | 428/665 |
| 3,384,464 | 5/1968 | Krock et al. | 428/665 |
| 3,703,405 | 11/1972 | Brenner et al. | 428/665 |
| 4,002,782 | 1/1977 | Warner et al. | 428/665 |
| 4,011,037 | 3/1977 | Mathieu et al. | 432/258 |
| 4,190,493 | 2/1980 | Yee | 428/665 |
| 4,259,061 | 3/1981 | Dubetsky | 432/258 |

FOREIGN PATENT DOCUMENTS

| | | | |
|---|---|---|---|
| 2448820 | 4/1975 | Fed. Rep. of Germany | 432/258 |
| 2-187591 | 7/1990 | Japan | 432/258 |

*Primary Examiner*—John Zimmerman
*Attorney, Agent, or Firm*—Foley & Lardner

[57] ABSTRACT

A high temperature heat-treating jig characterized by forming a tungsten layer or a tungsten alloy layer on the surface of a heat-resistant base to avoid discoloration and color shading during the heat treatment at a high temperature.

10 Claims, No Drawings

HIGH TEMPERATURE HEAT-TREATING JIG

BACKGROUND OF THE INVENTION

This invention relates to a jig for high temperature heat treatment, and particularly to a jig which is used for sintering various ceramics More particularly, the invention relates to a high temperature heat-treating jig which has excellent high-temperature strength, to which ceramic material hardly adheres, and in which discoloration and color shading hardly occur.

Heretofore, as a high temperature heat-treating jig, a plate material of molybdenum or molybdenum alloy, which is a heat-resistant material, has been generally used. This plate material has been generally produced as follows. First, an ingot prepared by sintering molybdenum powder is subjected to hot working, such as forging or rolling at high temperature into a plate material. This plate material is put to practical use as a jig in its final rolled form, or it is subjected to annealing to remove distortion caused during processing distortion at a secondary recrystallization temperature or below, generally at a temperature range of 800° to 1200° C., and then to fabrication before being put to practical use.

However, the inventors of the present invention found that the aforesaid conventional high temperature heat-treating molybdenum jig sometimes causes discoloration and color shading of the sintered part and the molybdenum jig during sintering of ceramics (for example, at sintering temperatures of 1500° to 2000° C.), and sometimes causes the sintered part to adhere to the jig.

SUMMARY OF THE INVENTION

This invention has as its objective to solve the above problems and aims to provide a high temperature heat-treating jig which solves the aforementioned disadvantages of a conventional high temperature heat-treating jig, which minimizes discoloration and color shading during the heat treatment at high temperature, and which eliminates adhesion between a member to be heat-treated and the jig.

In accomplishing the foregoing objectives, there has been provided in accordance with one aspect of the present invention a high temperature heat-treating jig, comprising a heat-resistant base; and a tungsten layer or tungsten alloy layer formed on one surface of the heat-resistant base. Preferably, the heat-resistant base comprises molybdenum or a molybdenum alloy.

According to another aspect of the invention, there has been provided a method of forming a high temperature jig of the type described above, comprising the steps of providing a heat-resistant base comprised of molybdenum or a molybdenum alloy; and applying a coating layer on one surface of the base, comprised of tungsten or a tungsten alloy.

According to yet another aspect of the invention, there has been provided a method of sintering a ceramic substrate, comprising the steps of providing a sintering vessel comprising a heat-treating jig as defined above; placing on the layer of tungsten or tungsten alloy a ceramic substrate to be sintered; and subjecting the ceramic substrate to sintering conditions while positioned on the layer.

Further objects, features and advantages of the present invention will become apparent from the detailed description of preferred embodiments which follows.

DETAILED DESCRIPTION OF THE PREFERRED EMBODIMENTS

The inventors have discovered that adhesion between a jig and the ceramic material and discoloration or color shading during heat treatment take place by the dispersion of one or more elements of the member to be heat-treated into the floor plate when treating at a high temperature. It was found that providing a barrier through which dispersion eventually cannot take place is very effective to prevent the dispersion. It was determined that dispersion into tungsten is about 1/1000 of dispersion into molybdenum, for example, although this dispersion varies depending on elements. Since tungsten has sufficient heat resistance, providing a tungsten layer on the surface of a heat-resisting base has been found by the inventors to be very effective for accomplishing the objectives of this invention.

The high temperature heat-treating jig of this invention has a tungsten layer or tungsten alloy layer formed on the surface of a heat-resistant base. In a preferred embodiment of this invention, the heat-resistant base can be made of molybdenum.

One example of the method for producing the high temperature heat-treating molybdenum jig of this invention involves placing a tungsten powder or tungsten oxide (W-Blue Oxide) powder on a molybdenum base and annealing it at 1700° C. or above, thereby forming a tungsten layer on the molybdenum base.

Another production method of the high temperature heat-treating molybdenum jig of this invention comprises dissolving a tungsten powder or tungsten oxide (W-Blue Oxide) powder in a solvent to prepare paste, which is then applied to a molybdenum base, and annealing the coated base at 1700° C. or above, thereby forming a tungsten layer on the molybdenum base.

Still another production method of the high temperature heat-treating molybdenum jig of this invention comprises applying a salt solution of tungsten onto a molybdenum base and annealing it at 1700° C. or above to form a tungsten layer on the molybdenum base.

Further, another production method of the high temperature heat-treating molybdenum jig of this invention comprises placing a tungsten plate or tungsten alloy plate on a molybdenum base and annealing the laminate at 1700° C. or above, thus forming a tungsten layer on the molybdenum base.

A further production method of the high temperature heat-treating molybdenum jig of this invention involves the application of a coating of tungsten on a molybdenum base by a CVD or PVD method.

The high temperature heat-treating jig of this invention has a tungsten layer or tungsten alloy layer formed on the surface of a heat-resistant base. As the heat-resistant base, those made of molybdenum, and ceramics such as alumina or thermet can be used. In view of its properties of resisting deformation, processability and cost, one made of molybdenum is preferable. For example, as a structural material for the molybdenum base, a conventional high temperature heat-treating molybdenum material, such as a doped molybdenum material containing one or more of Al, Si and K, can be used. Pure molybdenum can be also used. When using the doped molybdenum material, a sintered doped molybdenum is hot-worked, and then the processed material is used for fabrication, or it is annealed at its recrystallization temperature or below, generally at 800° to 1200° C., to remove distortion before fabricating, or it is further heat-treated at a temperature higher than the recrystallization temperature (for example, 100° C. higher than the recrystallization temperature and up to 2200° C.) before being used as the molybdenum base.

On the surface of the above heat-resistant base, a tungsten layer or tungsten alloy layer is formed, so that the tungsten layer or tungsten alloy layer works to prevent the elements of a member to be heat-treated from being dispersed into the heat-resisting base during heat treatment. For example, when the dispersion coefficient of each element into Mo and W base materials is compared, the dispersion coefficient of Fe at 1700° C. for example is $1.33\times10^{-14}$ m$^2$/s into the Mo base material and $5.37\times10^{-19}$ m$^2$/s into the W base material, the dispersion coefficient of Nb is $2.09\times10^{-15}$ m$^2$/s into the Mo base material and $2.41\times10^{-19}$ m$^2$/s into the W base material, the dispersion coefficient of Re is $4.23\times10^{-16}$ m$^2$/s into the Mo base material and $7.15\times10^{-19}$ m$^2$/s into the W base material, and the dispersion coefficient of U is $3.23\times10^{-15}$ m$^2$/s, into the Mo base material and $9.39\times10^{-19}$ m$^2$/s into the base material. Dispersion into W is quite small as compared to that into Mo, although the degree of difference depends on the type of dispersion element. Essentially, the same relationship exists in the case of other heat-resistant bases (such as Ta). Therefore, forming the tungsten or tungsten alloy layer on the heat-resistant base surface prevents the dispersion of the elements of a member to be heat-treated into the heat-resistant base. As a result, discoloration and color shading of the jig and the member to be heat-treated can be prevented from occurring, and also the jib and the member to be heat-treated can be prevented from adhering to each other. Further, tungsten has sufficient heat resistance and excellent strength at high temperatures, so that a long service life of the jig can be maintained.

In this invention, one preferred example of a tungsten alloy layer includes a rhenium-tungsten alloy.

The tungsten layer or tungsten alloy layer to be formed on the heat-resistant base surface has a thickness of about 0.2 micrometer or more, and preferably about 0.5 micrometer or more. When it is less than about 0.2 micrometer, providing the layer does not result in a sufficient barrier effect. The upper limit of the layer thickness is not particularly restricted, but making the layer very thick takes a long time for heat treating. Therefore, it is preferably up to about 20 micrometers.

One method of forming the tungsten layer on the molybdenum base by the present invention involves placing tungsten powder or tungsten oxide powder on a molybdenum base and annealing at about 1700° C. or above.

The tungsten powder or tungsten oxide powder used here preferably has an average particle diameter of about 0.4 to 5 micrometers, and the heat-treating temperature is from about 1700° C. up to about 2200° C. When the heat-treating temperature is less than 1700° C., sintering takes a long time, so that such a temperature must be retained for a long time. On the other hand, when the temperature exceeds 2200° C., furnace service life is shortened very much, and it is not economical. The heat-treating time is about one to ten hours. The heat treatment is preferably effected in a reducing atmosphere, such as hydrogen or a wet hydrogen atmosphere.

The thickness of the tungsten layer formed by the heat treatment varies depending on conditions, such as heat-treating temperature and heat-treating time. For example, heat treatment effected at 1800° C. for 8 hours forms a tungsten layer having a thickness of about micrometer.

Another method of forming the tungsten layer on the molybdenum base by the present invention comprises dissolving tungsten powder or tungsten oxide powder in a solvent to prepare a paste, which is then applied on the molybdenum base, and then annealing the coated base at a temperature above about 1700° C. The tungsten powder or tungsten oxide powder used here has the same average particle diameter as above. The solvent used to form the paste includes, for example, methyl cellulose-based binder, ethanol, acetone and water. Application of the paste onto the molybdenum base is done by using a brush or by spraying. Thus, the paste is applied on the molybdenum base, and the solvent is thermally decomposed at about 400° C; then annealing is done at a temperature of 1700° C. or above. The heat-treating conditions (temperature, time and atmosphere) for annealing are the same as above.

The thickness of the tungsten layer formed by the heat treatment varies depending on conditions, such as heat-treating temperature and heat-treating time. For example, heat treatment effected at 1800° C. for 8 hours forms a tungsten layer having a thickness of about 0.8 micrometer.

Another method of forming the tungsten layer on the molybdenum base by the present invention involves applying a salt solution of tungsten onto the molybdenum base and annealing at a temperature of 1700° C. or above. The salt solution of tungsten used here includes, for example, tungsten acid ammonia solution, tungsten acid sodium solution, and tungsten acid solution.

The salt solution of tungsten is applied onto the molybdenum base, and the solvent is thermally decomposed at about 400° C.; then annealing is effected at a temperature of 1700° C. or above. The heat treating conditions (temperature, time and atmosphere) for annealing are the same as above.

The thickness of the tungsten layer formed by the heat treatment varies depending on the conditions, such as heat-treating temperature and heat-treating time. For example, heat treatment effected at 1800° C. for 3 hours forms a tungsten layer having a thickness of about 1.1 micrometer.

Another method of forming the tungsten layer on the molybdenum base by the present invention comprises placing a tungsten plate or tungsten alloy plate on the molybdenum base and annealing at a temperature of 1700° C. or above. A tungsten plate or tungsten alloy plate having a thickness of about 0.1 to 10 mm is placed on the molybdenum base or sandwiched between the molybdenum bases, and heat treatment is effected for dispersion, thereby forming a tungsten layer or tungsten alloy layer on the molybdenum base surface.

The preferred tungsten alloy used here includes a rhenium-tungsten alloy. The heat treating conditions (temperature, time and atmosphere) for annealing are the same as above.

The thickness of the tungsten layer formed by the heat treatment varies depending on the conditions, such as heat-treating temperature and heat-treating time. For example, heat treatment effected at 1800° C. for 3 hours forms a tungsten layer having a thickness of about 0.3 to 0.5 micrometer.

Another method of forming the tungsten layer on the molybdenum base by the present invention comprises the provision of a tungsten coating on the molybdenum base by a CVD or PVD method. In the CVD method, a reactive gas is caused to flow over a molybdenum base at a high temperature to deposit a solid layer of tungsten on the base. The treating conditions include a base temperature of about 900° to 1100° C., and preferred examples of reactive gas include tungsten hexafluoride, $H_2$ or $H_2+N_2$ gas.

In the PVD method, tungsten is vapor-deposited or sputtered onto the molybdenum base in vacuum, or in the presence of a low-pressure gas, and includes vacuum vapor deposition, sputtering and ion plating methods. Any of these methods can be used, but the ion plating method is most preferable.

The CVD or PVD method forms a tungsten coating of about 0.2 to 20 micrometers in thickness.

Another method for forming a tungsten layer on the molybdenum substrate according to this invention comprises calcining a ceramic substrate (e.g. $Al_2O_3$, AlN, etc.) having a conductive layer of W (at 1100° C. to 1800° C. for example) to form the W layer on the molybdenum substrate by vaporizing, depositing and dispersing.

Examples of the conductive layer on the ceramic substrate include many, such as molybdenum, tantalum and tungsten. Calcining the ceramic substrate possessing an area of tungsten conductor can form a tungsten layer on the molybdenum substrate. The thickness of the tungsten layer formed by this thermal treatment varies depending on the thermal treating temperature, the thermal treating time and the size and number of the ceramic substrates. For example, when a 130×103-mm $Al_2O_3$ substrate possessing a conductive layer W is thermally treated at 1800° C. for 3 hours, there is formed a tungsten layer of about 0.3 to 0.5 micrometer. This method does not require a user who wants to employ a molybdenum plate to use a special manufacturing device or apparatus to prepare the coated plate according to the invention, and for this reason, the invention is very useful. That is to say, when a molybdenum jig is used, it is sufficient to intentionally form a layer W on the molybdenum plate by calcining (sintering) any ceramics substrate possessing a tungsten conductive layer.

The preferred examples of the production method of this invention are mainly related to the forming of a tungsten layer; however, it is readily apparent that such methods can be applied for forming a tungsten alloy layer.

The following examples illustrate numerous preferred embodiments of the invention more specifically. It is to be understood, however, that the invention is not limited to these examples.

EXAMPLE 1

On a molybdenum base, tungsten oxide powder (average particle diameter: 5 micrometers) was evenly placed. Sintering was done by heating in hydrogen or wet hydrogen atmosphere at 1700° to 2000° C. for 8 hours (in which the tungsten oxide powder was reduced). Excess W powder was removed from the sintered product obtained. W was dispersed into the molybdenum plate during the high-temperature treatment and formed a W layer to a thickness of about 1 micrometer.

On the molybdenum floor plate thus obtained, an alumina base is placed, and sintering was effected at 1700° C. for 5 hours. The same sintering process was performed 50 times. As a result, the molybdenum floor plate did not adhere to the alumina base. Neither the alumina base nor the molybdenum floor plate suffered from discoloration or color shading.

EXAMPLE 2

At the final annealing of a molybdenum base, a 0.2 mm W plate having the same size as the molybdenum base was placed on top of the base. The heat-treating conditions include 1800° C.×three hours in a hydrogen atmosphere. As a result, it was confirmed that a W layer having a thickness of about 0.3 to 0.5 micrometer was formed on the molybdenum plate surface.

An alumina plate was placed on the molybdenum floor plate and sintered at 1700° C. for 5 hours. The same sintering process was performed 50 times. As a result, the molybdenum floor plate did not adhere to the alumina plate at all, and the alumina plate and the molybdenum floor plate were not discolored or color shaded.

EXAMPLE 3

To remove the oxides and adhered substance from the surface of a molybdenum base, it was washed with nitric acid, hydrochloric acid and hot water and was then dried. Then it was placed in a CVD furnace and kept at 1100° C. Tungsten hexafluoride and hydrogen gas were injected into the furnace to form a tungsten CVD coating to a thickness of about 1 micrometer.

On the molybdenum floor plate obtained, an alumina base was placed. Sintering was effected at 1700° C. for 5 hours. The same sintering process was performed 50 times. As a result, the molybdenum floor plate did not adhere to the alumina base at all. Neither the alumina base nor the molybdenum floor plate suffered from discoloration or color shading.

EXAMPLE 4

As a molybdenum plate material, molybdenum powder having a purity of 99.9% or above and an average particle diameter of 3 to 5 micrometers was press-molded under a pressure of 2 tons/cm$^2$ by a hydraulic press according to a powder metallurgy method and sintered at 1900° C. for 5 hours to form a pure molybdenum ingot having a thickness of about 30 mm. This ingot was heated to a maximum temperature of 1300° C. and rolled while gradually lowering the heating temperature according to the ordinary hot processing method. This procedure was repeated. As a result of the hot roll processing and cold roll processing, a molybdenum plate having a thickness of 2 mm was obtained.

This molybdenum plate was subjected to the crystal grain control method in a current of hydrogen at 2250° C. for about 2 to 3 hours to obtain a molybdenum plate in which the disc shaped crystals in their circular part have a disc diameter of 20 mm on the average.

A multilayer ceramics substrate having a layer of W will be described.

A raw material green sheet was prepared by adding 3 wt. % of a sintering aid of 1.2 μm mean dia. $Y_2O_3$ to 1.5 μm mean particle size AlN powder, including 1.4 wt. % oxygen as an impurity, and by wet-blending the two for 24 hours with a ball mill. An organic binder was dispersed into this prepared raw material together with an organic solvent to form a slurry. The slurry was formed into a green sheet with a uniform thickness of 100 to 400 μm in accordance with the doctor blade method. The green sheet was cut into an about 130×130 mm square insulating body, and a 300 μm dia. hole was formed to connect electric circuits formed on the insulating layers.

A tungsten paste was prepared. To adjust the tungsten paste to 97 wt %, 1.29 wt % of $Al_2O_3$ having an average particle diameter of 1 micrometer and 1.71 wt. % of $Y_2O_3$ having an average particle diameter of 1.2 micrometers were added. The resulting tungsten paste was printed onto the green sheet by the screen printing method. Naturally, the holes in the green sheet are filled with the tungsten paste. This green sheet was piled on top of another and hot-pressed to prepare a laminated green sheet.

This laminated green sheet was placed on the molybdenum plate obtained above and subjected to the next heating treatment.

To evaporate the binder, the sheet was heated in a $N_2$ atmosphere, then sintered in a $N_2$ atmosphere at 1800° C. for 5 hours. There was obtained a multilayer AlN substrate. At the same time, a tungsten layer having a thickness of about 0.7 micrometer was obtained on the molybdenum plate.

To make sure that the entire surface is covered, the same molybdenum plate was calcined and sintered again. Specifically, the laminated green sheet was differently positioned from the above heating step and treated by the same procedure as above except that sintering was effected for 3 hours. As a result, a tungsten layer having a thickness of about 1 micrometer was formed on the molybdenum plate.

On the thus-obtained molybdenum floor plate was placed an alumina substrate which was then sintered at 1700° C. for 5 hours. Even after repeating this procedure 50 times, the molybdenum floor plate did not adhere to the alumina substrate. Also, the alumina substrate and the molybdenum floor plate did not undergo discoloration or color shading.

With the high temperature heat-treating jig of this invention, a tungsten layer or tungsten alloy layer was formed on the surface of a heat-resistant base. As compared with a conventional high temperature heat-treating jig, the member to be heat-treated does not adhere to the jig during the high temperature treating, and the occurrence of discoloration and color shading can be prevented. Particularly, when the heat-resistant base consists of molybdenum, since tungsten is very similar to molybdenum in properties such as heat resistance and strength at high temperature, the high temperature heat-treating jig of this invention can be used for high temperature heat treatment under the same conditions as those for a conventional molybdenum jig.

The foregoing description and examples have been set forth merely to illustrate the invention and are not intended to be limiting. Since modifications of the described embodiments incorporating the spirit and substance of the invention may occur to persons skilled in the art, the scope of the invention should be limited solely with reference to the appended claims and equivalents.

What is claimed is:

1. A high temperature heat-treating jig for sintering ceramic materials, comprising:

a molybdenum plate or molybdenum alloy plate heat-resistant base; and a tungsten layer or tungsten alloy layer formed on one surface of said heat-resistant base.

2. A high temperature heat-treating jig according to claim 1, wherein the crystal grains in said molybdenum plate or molybdenum alloy plate are disc shaped.

3. A high temperature heating jig according to claim 1, wherein the tungsten layer has a thickness of about 0.2 micrometer or above.

4. A high temperature heating jig according to claim 1, wherein the tungsten alloy layer has a thickness of about 0.2 micrometer or above.

5. A high temperature heating jig according to claim 1, wherein the tungsten layer has a thickness of about 0.5 micrometer or above.

6. A high temperature heating jig according to claim 1, wherein the tungsten alloy layer has a thickness of about 0.5 micrometer or above.

7. A high temperature heat-treating jig according to claim 1, wherein said jig is resistant to dispersion of said ceramic material.

8. A high temperature heat-treating jig according to claim 1, wherein said molybdenum plate or said molybdenum alloy plate is comprised of molybdenum doped with one or more dopants selected from the group consisting of Al, Si and K.

9. A high temperature heat-treating jig according to claim 1, wherein said tungsten alloy layer is a rhenium-tungsten alloy.

10. A high temperature heat-treating jig according to claim 1, wherein said tungsten layer or tungsten alloy layer is made from tungsten powder or tungsten oxide powder which has an average particle diameter of about 0.4 to 5 micrometers.

* * * * *